United States Patent [19]

Williams et al.

[11] Patent Number: 4,949,399

[45] Date of Patent: Aug. 14, 1990

[54] DEVELOPMENT STATION ENGAGEABLE WITH TONER MONITOR

[75] Inventors: Ralph E. Williams, Rochester; Ronald C. Holzhauser, Holley, both of N.Y.

[73] Assignee: Eastman Kodak Company, Rochester, N.Y.

[21] Appl. No.: 349,476

[22] Filed: May 9, 1989

[51] Int. Cl.[5] ..... G03G 15/06

[52] U.S. Cl. ..... 355/260; 118/691; 206/316.1; 355/245

[58] Field of Search ..... 355/260, 245, 246; 206/316; 118/691, 689

[56] References Cited

U.S. PATENT DOCUMENTS

| | | | |
|---|---|---|---|
| 4,108,545 | 8/1978 | Eckert | 355/246 X |
| 4,610,532 | 9/1986 | DeSchamphelaere | 355/246 |
| 4,620,783 | 11/1986 | Tanaka | 355/245 X |
| 4,692,018 | 9/1987 | Tamura | 355/260 |
| 4,758,861 | 7/1988 | Nakamaru | 355/246 X |

*Primary Examiner*—A. T. Grimley
*Assistant Examiner*—Thu Dang
*Attorney, Agent, or Firm*—Milton S. Sales

[57] ABSTRACT

A replaceable development station usable for developing electrostatic images in apparatus having a toner monitor and a device for slidably receiving the development station includes a chamber containing a supply of a development mixture of toner and carrier particles. A recess is defined in one wall of the chamber for receiving the toner monitor, the recess being defined by a thinned region of the wall such that the toner monitor is separated from the developer mixture by a wall region substantially thinner than the general wall thickness. A device is provided for camming the development station tightly against the toner monitor and clamping it there such that the resilient force needed to maintain contact is minimized.

6 Claims, 5 Drawing Sheets

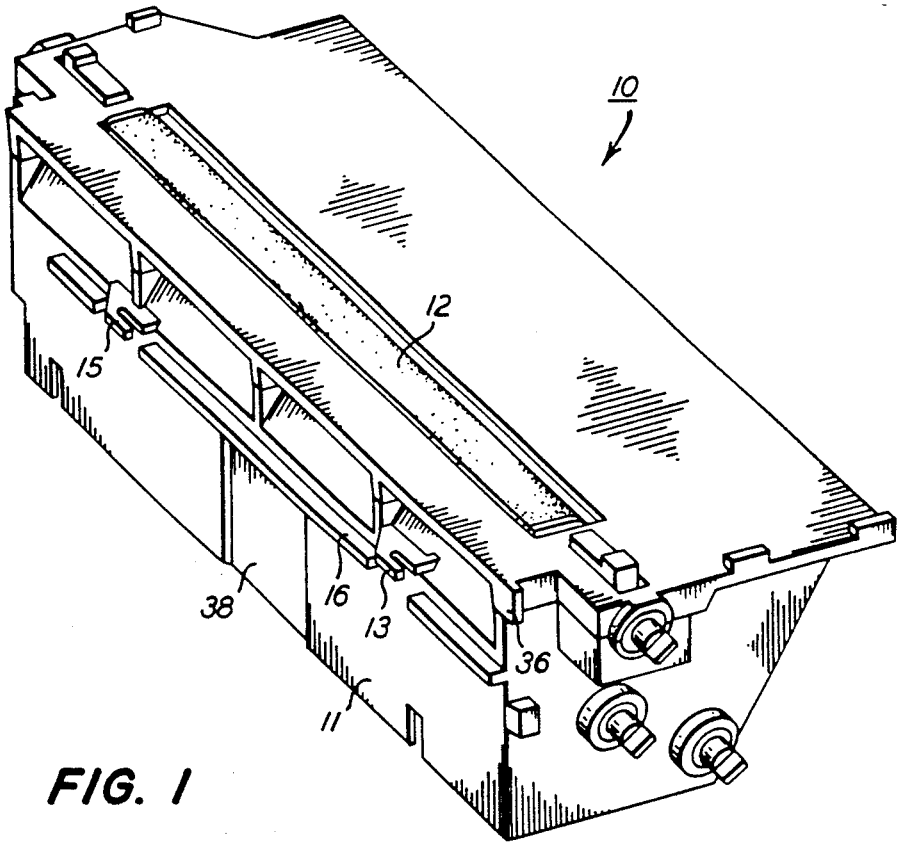
FIG. 1
FIG. 5
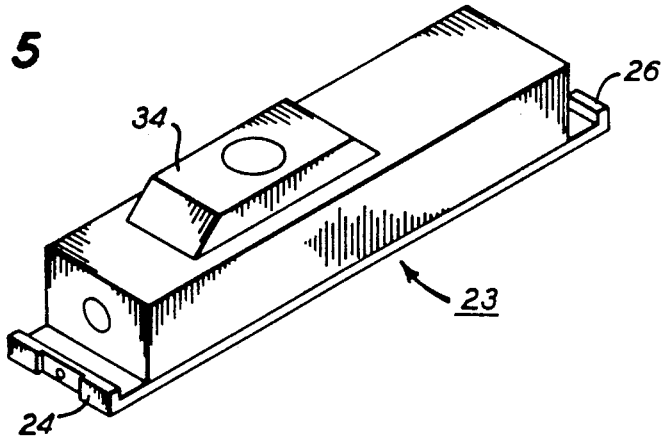

DEVELOPMENT STATION ENGAGEABLE WITH TONER MONITOR

CROSS REFERENCE TO RELATED APPLICATIONS

Reference is made to commonly assigned U.S. patent applications Ser. No. 215,971 filed by K. A. Arnold, L. A. Hill, and K. S. Robinson on July 7, 1988, and Ser. No. 258,938 filed by L. A. Hill, A. S. Kroll, and R. E. Williams on Oct. 17, 1988.

TECHNICAL FIELD

This invention relates generally to replaceable development stations for use in electrostatographic machines having developer mixture concentration monitors.

BACKGROUND ART

Electrostatographic machines generally use a two-component developer mixture comprised of a toner powder and a magnetized or magnetizable carrier material. During the use of the machine, toner powder must be replenished to compensate for its consumption during image development. Various automatic toner replenishment systems are known wherein a signal from a toner concentration monitor controls replenishment. Toner concentration monitors may take several forms, including optical sensors, capacitance sensors, resistance sensors, inductance sensors, magnetic sensors, etc.

Commonly assigned U.S. Pat. No. 4,797,704 which issued to L. A. Hill and M. E. Jacobs on Jan. 10, 1989, and U.S. patent application Ser. No. 215,971 filed by K. A. Arnold, L. A. Hill, and K. S. Robinson on July 7, 1988 disclose a replaceable development station for developing electrostatic images. The device is slid endwise into place in an electrostatographic machine so that the entire development station is removable when its original supply of toner is exhausted.

Generally, such development stations are disposable. Therefore it is not practical to provide a toner concentration monitor in each station. However, for toner monitors to work optimally, they must not be separated from the development mixture by thick development station walls. In commonly assigned U.S. patent application Ser. No. 258,938 filed by L. A. Hill, A. S. Kroll, and R. E. Williams on Oct. 17, 1988, a thinned region is defined in the wall of the development station such that the toner monitor is separated from the developer mixture by a wall region substantially thinner than the general wall thickness. The thinned region is formed by a recess in the wall of the station into which the toner monitor is urged when the station is slid into a receiving channel. The toner monitor is cammed away from the station as the development station is slid into the receiving means, and is resiliently urged into the recess when the development station is fully inserted in the receiving channel.

DISCLOSURE OF INVENTION

In accordance with the above object, the present invention provides a replaceable development station usable for developing electrostatic images in apparatus having a toner monitor and means for slidably receiving the development station. The development station includes a chamber containing a supply of a development mixture of toner and carrier particles. A recess is defined in one wall of the chamber for receiving the toner monitor, the recess being defined by a thinned region of the wall such that the toner monitor is separated from the developer mixture by a wall region substantially thinner than the general wall thickness.

The development station is usable in apparatus having a toner monitor and means for slidably receiving the development station. When the station is slid into or out of the receiving channel, the toner monitor is cammed away from the station against a resilient force. Means are provided for camming the development station tightly against the toner monitor and clamping it there such that the resilient force needed to maintain contact is minimized.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1 is a perspective view of a replaceable development station constructed according to the present invention;

FIG. 5 is a perspective view of a toner monitor;

BEST MODE FOR CARRYING OUT THE INVENTION

Figure 2:
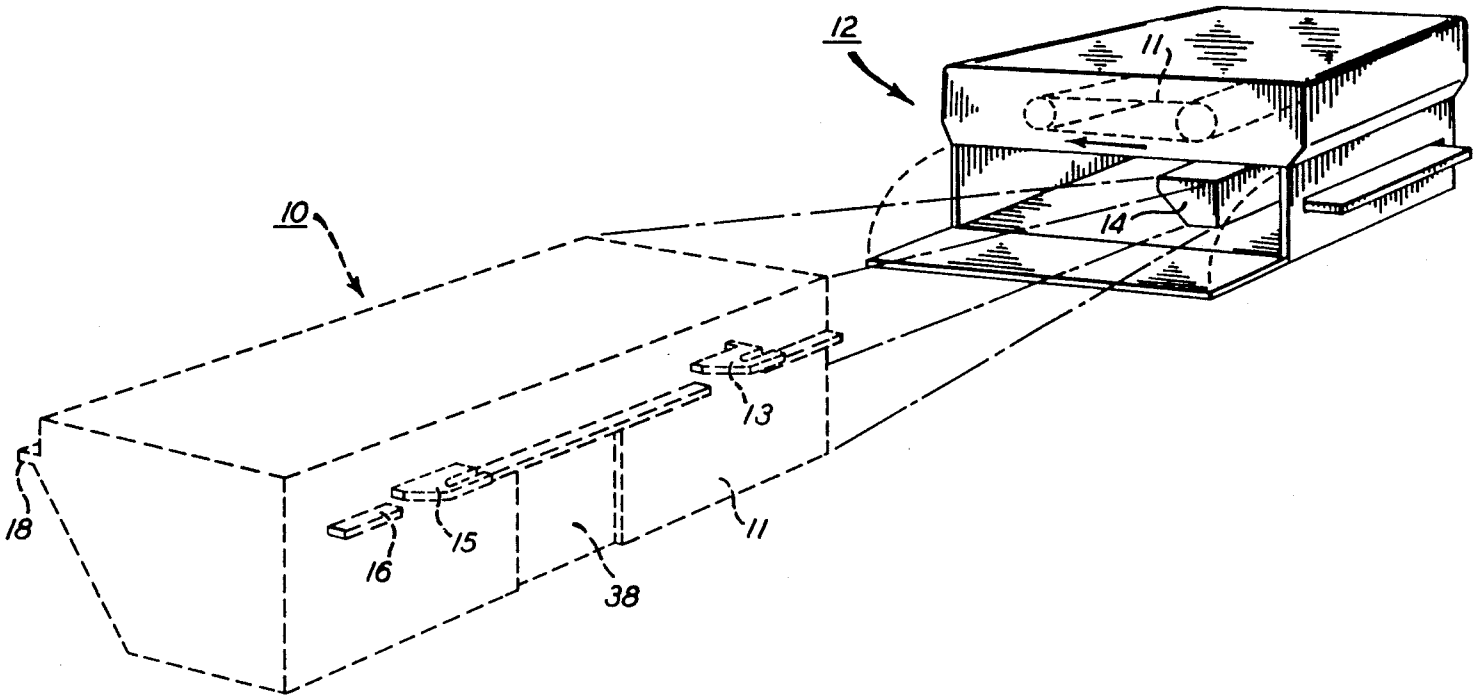
FIG. 2 is a perspective schematic view of the development station of FIG. 1, and further showing an electrostatographic machine usable therewith.

Referring to FIG. 1 of the drawings, a replaceable development station according to a preferred embodiment of the present invention is generally designated 10 with wall means defining a chamber containing a supply of a development mixture of toner and carrier particles. The development station has a disposable plastic housing 11 and an applicator 12. Further details of the replaceable development station can be found in abovementioned U.S. Pat. No. 4,797,704. The disclosure of that patent is specifically incorporated by reference herein. A pair of interface hooks 13 and 15 are provided on the development station, and will be explained in detail below. As shown in FIG. 2, development station 10 can be used to develop latent electrostatic images on a photoconductor 11 of an electrostatographic machine such as a copier or printer 12 as the photoconductor is driven past the development station in the direction indicated by the arrow.

Figure 3:
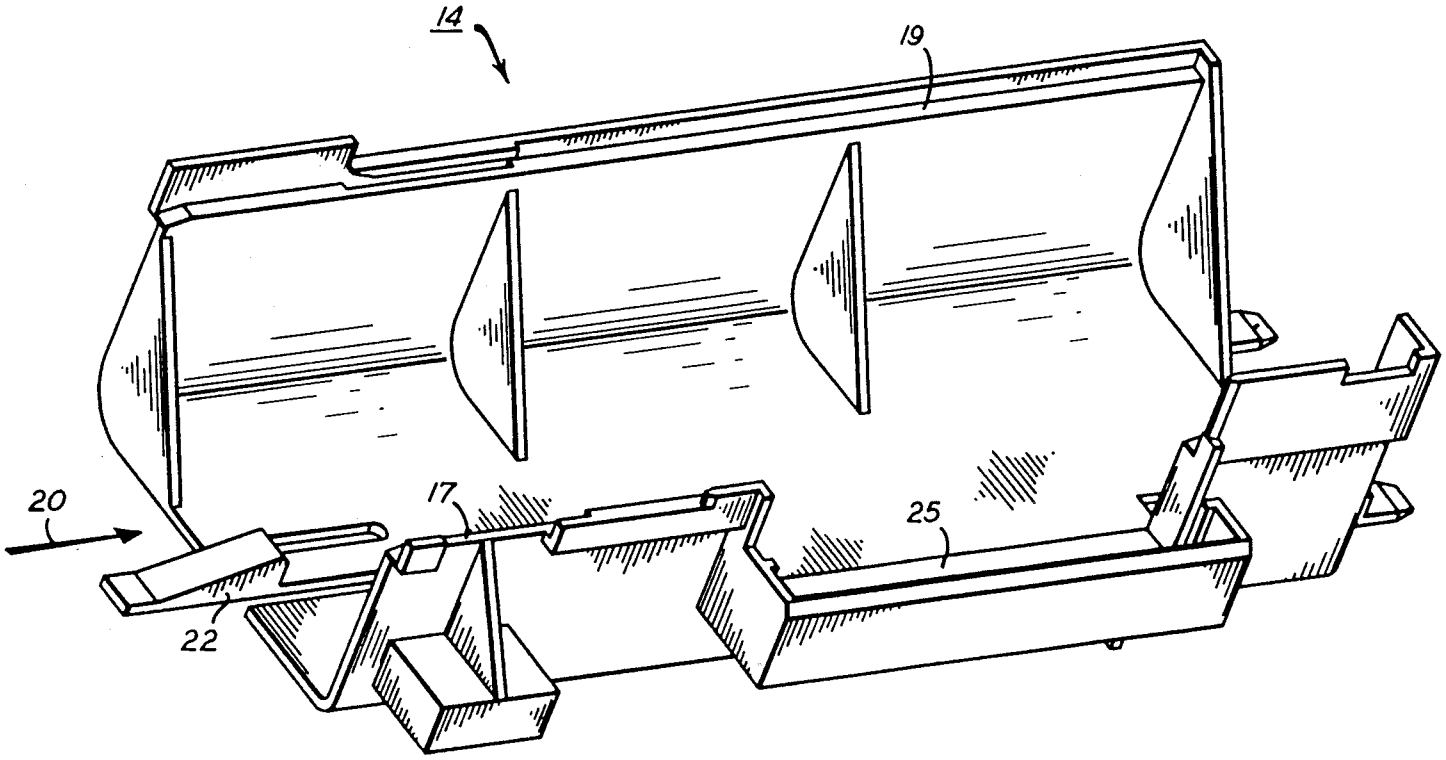
FIG. 3 is a perspective view of a channel portion of the electrostatographic machine of FIG. 2 adapted to receive the development station of FIG. 1.
Figure 4:
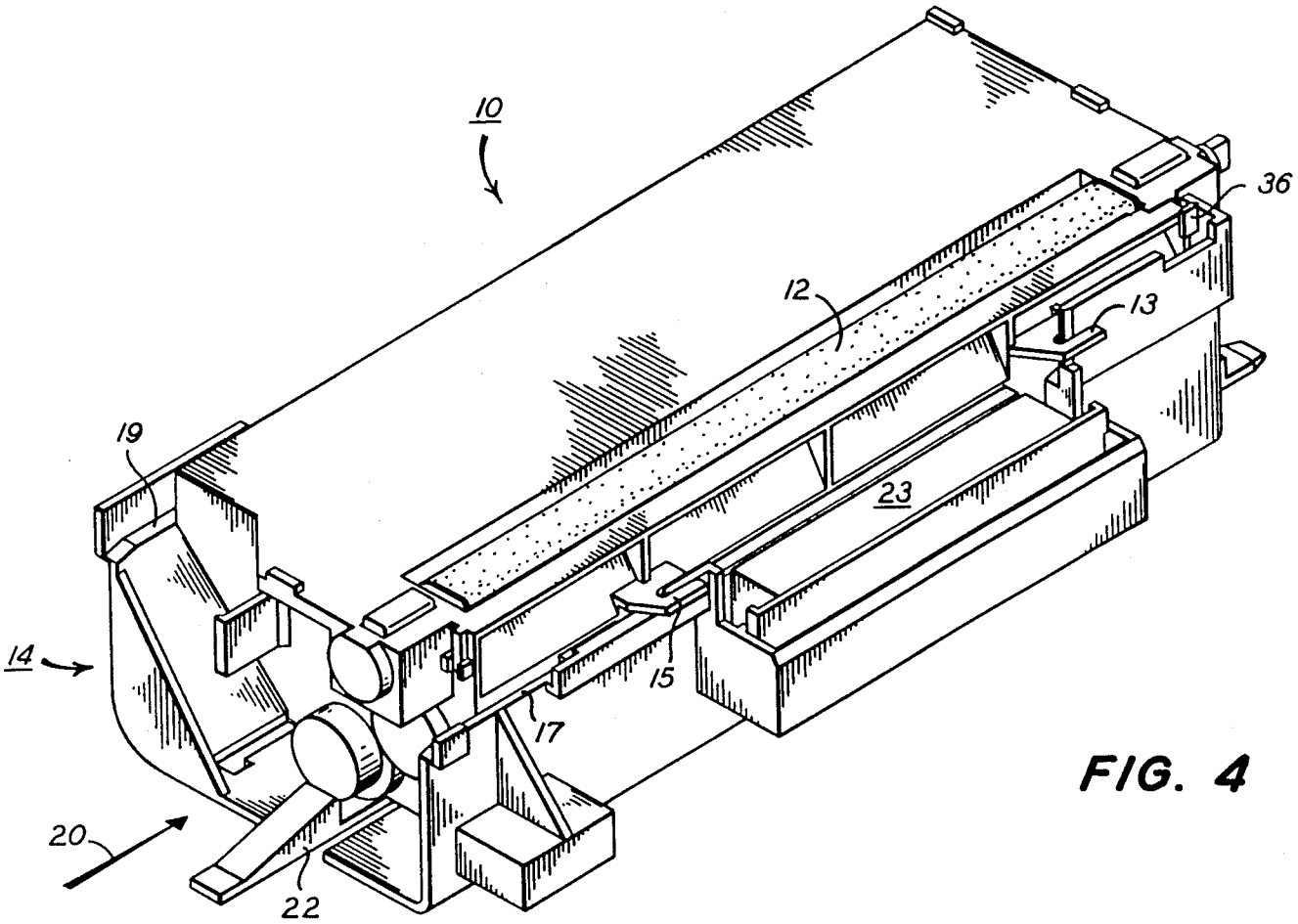
FIG. 4 is a perspective view of the development station of Figure one received in the channel of FIG. 3.

Development station 10 preferably has suitable guides 16 and 18 for facilitating location of the station in a receiving channel 14 of copier or printer 12. The receiving channel is shown in greater detail in FIG. 3 and with a received development station in FIG. 4. Development station guides 16 and 18 slide respectively on surfaces 17 and 19 of the receiving channel as the station is inserted into the channel in the direction of arrow 20. A spring-biased tab 22 releasably latches the development station in the receiving channel.

Figure 6:
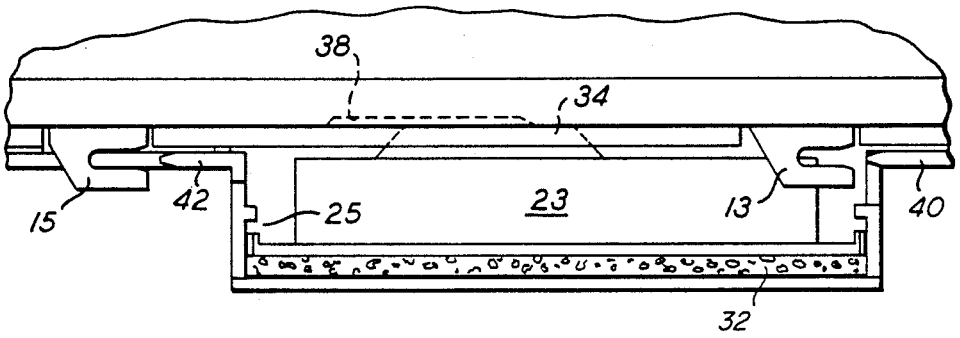
FIGS. 6 and 7 are top views of portions of the development station of FIG. 1 and the receiving channel of FIG. 3 in progressive stages of loading.

A toner monitor 23, best seen in FIGS. 5 and 6, is provided in receiving channel 14 for measuring the toner concentration of the developer mixture in development station 10. Toner monitors are well known, and may be of several types, such as, for example, those described in the Background Art section hereof.

As seen in FIG. 6, toner monitor 23 is carried in a cavity 25 in receiving channel 14. The monitor is resiliently urged forwardly in the cavity by a foam pad 32. When unimpeded, a portion 34 of the monitor extends into the region which receives development station 10.

Figure 7:
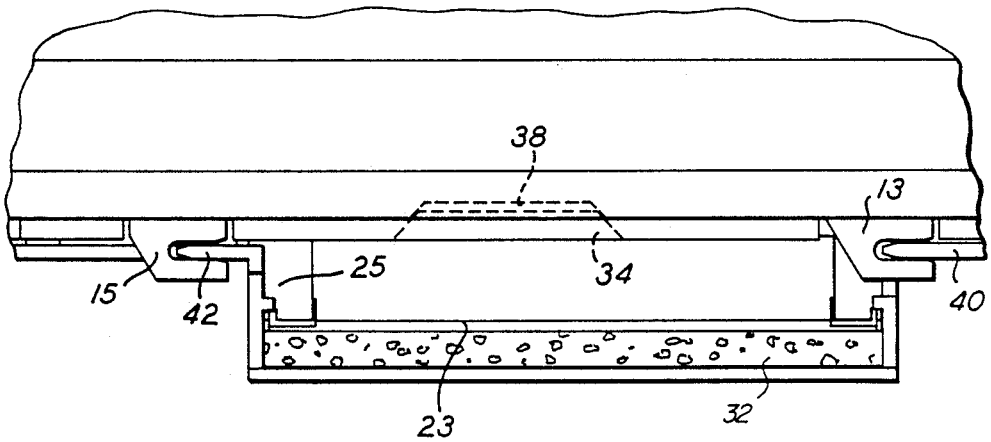

FIGS. 6 and 7 show the relative positions of receiving channel 14, development station 10, and toner monitor 23 as the development station is slid into the receiving channel. A cam member 36 (FIG. 1) of the development station first engages portion 34 of toner monitor 23 and pushes the toner monitor rearwardly in cavity 25 against the resilient force of foam pad 32; making way for further insertion of the development station into the receiving channel as shown in FIG. 6.

Referring to FIG. 7, as the development station approaches its fully-inserted position, portion 34 of the toner monitor aligns with a recess 38 in plastic housing 11 of the development station, and the toner monitor moves forwardly of cavity 25 and extends into recess 38.

Recess 38 is defined by a thinned region of the wall of the development station, and is provided so that the toner monitor is separated from the development mixture by as thin a development station wall as possible, while still maintaining structural integrity of the development station.

Referring back to FIG. 6, as development station approaches its fully-inserted position in receiving channel 14, interface hooks 13 and 15 are substantially aligned with a pair of protrusions 40 and 42, respectively. There is some small offset between the interface hooks and the protrusions so that, for the interface hooks to fit over the protrusions, the development station is drawn or cammed tightly against the wall of the receiving chamber which carries toner monitor 23.

By drawing the development station toward the toner monitor, the interface hooks insure constant contact between the monitor and the station wall. Such high degree of contact could not be achieved without the hooks. For example, if the resiliency of foam pad 32 were increased to a stiffness necessary for good contact between the toner monitor and the station wall, unsatisfactorally high forces would resist insertion and removal of the development station into and out of the receiving channel. By providing the hooks, application of the side force is delayed until the development station is substantially all the way into the receiving channel.

When the development station is withdrawn from the receiving channel, an inclined wall on the trailing edge of recess 38 engages an inclined wall on toner monitor portion 34 and cams the toner monitor back into cavity 25 to make room for the development station to pass.

The invention has been described in detail with particular reference to preferred embodiments thereof, but it will be understood that variations and modifications can be effected within the spirit and scope of the invention.

What is claimed is:

1. A replaceable development station usable for developing electrostatic images in apparatus having a toner monitor and means for slidably receiving said development station; said development station comprising:

wall means for defining a chamber containing a supply of a development mixture of toner and carrier particles; and means for drawing said development station firmly into contact with the toner monitor when said development station is received in the apparatus.

2. A replaceable development station usable for developing electrostatic images in apparatus having at toner monitor and means for slidably receiving a said development station; said development station comprising:

wall means for defining a chamber containing a supply of a development mixture of toner and carrier particles; and means for drawing said development station firmly into contact with the toner monitor when said development station is received in the apparatus, wherein said means for drawing said development station into contact with the toner monitor comprises cam means, engageable with the means for receiving said development station.

3. A replaceable development station as defined in claim 2 wherein said cam means comprises at least one hook on said development station which engages a protrusion on the receiving means to clamp the development station against the toner monitor.

4. A replaceable development station usable for developing electrostatic images in apparatus having a toner monitor movable in first and second opposed directions and means for slidably receiving said development station in third and fourth opposed directions substantially normal to the first and second directions; said development station comprising:

a housing containing a development mixture of toner and carrier particles and including a wall normal to the first and second directions when the station is slid into the receiving means; and means for moving said development station in one of said first or second directions to draw wall of said housing firmly into contact with the toner monitor when said development station is received in the apparatus.

5. A replaceable development station as defined in claim 4 wherein said means for drawing said development station comprises cam means, engageable with the means for receiving said development station.

6. A replaceable development station as defined in claim 5 wherein said cam means comprises at least one hook on said development station which engages a protrusion on the receiving means to clamp the development station against the toner monitor.

* * * * *